United States Patent [19]

Owen

[11] Patent Number: 4,784,388

[45] Date of Patent: Nov. 15, 1988

[54] POCKET BILLIARDS GAME

[76] Inventor: Donald W. Owen, 803A Cardinal Creek Blvd., Norman, Okla. 73072

[21] Appl. No.: 910,208

[22] Filed: Sep. 22, 1986

[51] Int. Cl.[4] ..... A63G 31/00

[52] U.S. Cl. ..... 273/2; 273/22

[58] Field of Search ..... 273/2, 85 R, 3 R, 4 R, 273/22, 11 R

[56] References Cited

U.S. PATENT DOCUMENTS 3,578,321 5/1971 Skully ..... 273/2

3,618,944 2/1970 Myers ..... 273/22

*Primary Examiner*—Richard C. Pinkham

*Assistant Examiner*—T. Brown

*Attorney, Agent, or Firm*—Laney, Dougherty, Hessin & Beavers

[57] ABSTRACT

A method of playing a pocket billiards game utilizing fifteen object balls and a cue ball allows the cue ball and one of the object balls to be placed anywhere on the table at the beginning of each turn for each player. The remaining object balls are racked and aligned relative to the foot spot. A player's turn continues so long as an object ball is pocketed on each shot and there is at least one object ball remaining on the table and the player does not commit a foul. The game continues with each player taking a turn until each player has had a predetermined number of turns. Each player is assigned a handicap, and the winner of an event is the one having the highest score determined by adding the handicap to the actual number of legally pocketed balls per inning.

4 Claims, 1 Drawing Sheet

POCKET BILLIARDS GAME

BACKGROUND OF THE INVENTION

This invention relates generally to pocket billiards games and more particularly, but not by way of limitation, to a game methodology which uses fifteen object balls and one cue ball and which is played on a six-pocket billiards table.

Although there are several types of billiards games, I am not aware of any which is specifically designed so that players of unequal abilities can fairly compete gainst each other with one of lesser ability having a realistic or consistent opportunity to win. It is to satisfy this shortcoming that I have invented the game described and claimed hereinbelow.

SUMMARY OF THE INVENTION

The present invention overcomes the aforementioned short-coming by providing a novel and improved pocket billiards game which allows players of different abilities to compete against each other so that a player of lesser ability has a realistic and consistent opportunity to win. It is another object of the present invention to provide a game where a player's first shot of each turn has an improved opportunity for pocketing a ball as compared to conventional pocket billiards games requiring the first shot of a turn or of the game to be taken at a full rack of balls which, at least to relatively unskilled players, requires some degree of luck for a ball to go into one of the pockets.

In an embodiment of the present invention providing a game played on a pocket billiards table with fifteen object balls and a cue ball, which table has a foot spot, the game comprises the steps of aligning fourteen of the object balls into the shape of a truncated triangle having the missing apex of the truncated triangle substantially centered on the foot spot; placing the remaining object ball anywhere on the table; placing the cue ball anywhere on the table; moving the cue ball for the purpose of striking any of the object balls; repeating the step of moving the cue ball for the purpose of striking any of the object balls so long as both the immediately preceding moving of the cue ball caused at least one of the object balls to enter any of the pockets of the table and there is at least one object ball remaining on the table; and repeating the preceding steps a predetermined number of times. So that players of different abilities can compete in a common event of the game, the game further comprises assigning to each player a respective predetermined number representing a corresponding number of object balls for which the player will be credited each turn regardless of the actual number of object balls pocketed by the player during the turn.

Therefore, from the foregoing, it is a general object of the present invention to provide a novel and improved game played on a pocket billiards table. Other and further objects, features and advantages of the present invention will be readily apparent to those skilled in the art when the following description of the preferred embodiment is read in conjunction with the accompanying drawings.

DETAILED DESCRIPTION OF THE PREFERRED EMBODIMENT

Figure 1:
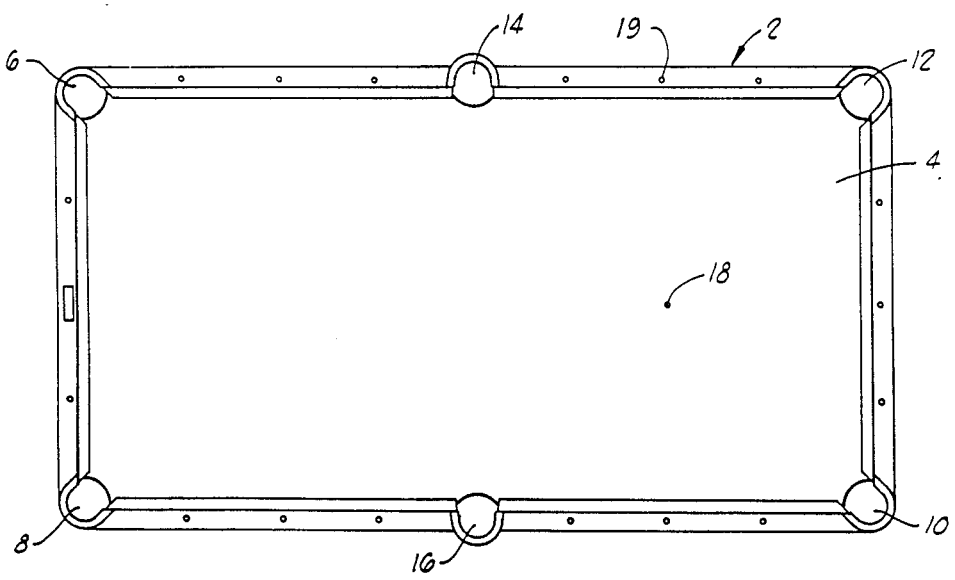
FIG. 1 illustrates a conventional pocket billiards table on which a foot spot is located and on which the preferred embodiment of the present invention is to be played.

The preferred embodiment of the present invention is to be played on a pocket billiards table 2 of the type shown in FIG. 1. The table 2 has a flat rectangular playing surface 4 at the corners of which are located four pockets 6, 8, 10, 12. Two additional pockets 14, 16 are located midway between the corner pockets along the longer sides of the playing surface 4. The table 2 also has a foot spot 18 marked at a predetermined location on the surface 4. In the illustrated embodiment of a conventional pocket billiards table, the foot spot 18 is located near the foot of the table 2 at the point where lines drawn from the center diamonds (or other form of marking) on the short rails and from the second diamonds (or other form of marking) on the long rails near the foot of the table 2 intersect (dots or circles, one of which is identified by the reference numeral 19 in FIG. 1, are used in the drawings to indicate the rail markings usually found on pocket billiards tables). Other markings, such as a head spot (not shown) could also be marked on the table; however, such other markings are not needed in the preferred embodiment of the game of the present invention.

Figure 2:
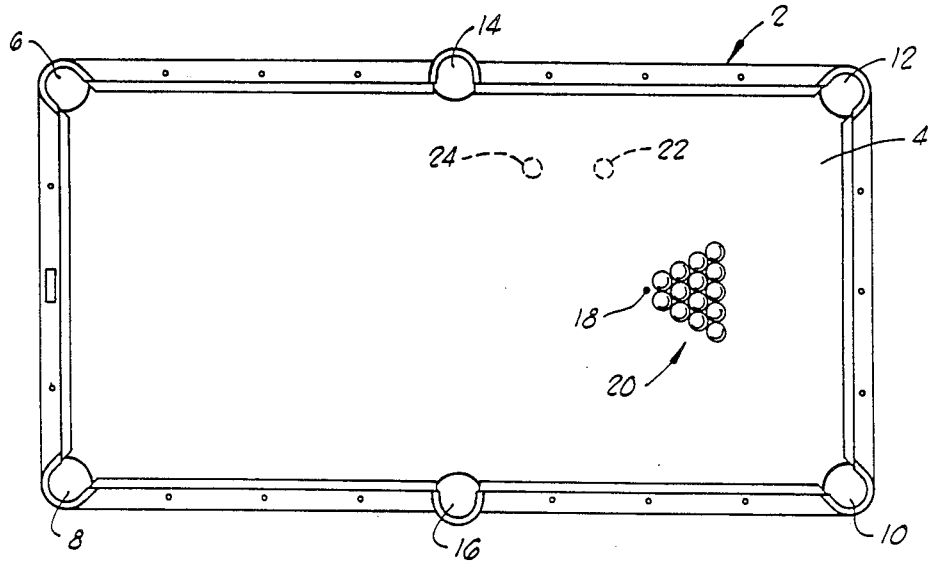
FIG. 2 illustrates the table of FIG. 1 with fourteen object balls rocked and aligned on the table in the predetermined manner of the preferred embodiment of the present invention and with a fifteenth object ball and a cue ball, which are shown in phantom to indicate that these two balls can be located anywhere on the table other than the specific locations of the fourteen racked balls.

The preferred embodiment of the present invention is to be played with a predetermined number, n, of object balls. A number $n-1$ of these balls are grouped, such as by being racked in a triangular rack or frame of a type as known in the art, to define a racked set of object balls 20. The remaining, or nth ball, is identified in FIG. 2 by the reference numeral 22. A cue ball 24 is also to be used. A cue (not shown) is used in the preferred embodiment to strike the cue ball 24 for moving it towards (either directly or indirectly, as by a bank shot) the object balls for the purpose of striking at least one of the object balls.

The object of the game of the present invention is to pocket in any of the pockets 6, 8, 10, 12, 14, 16 as many of the object balls 20, 22 as is possible in a specified number of turns. Each legally pocketed ball counts one point. A ball is "legally" pocketed if it is done without committing one of the following fouls: pocketing the cue ball; causing any ball to jump off the table; shooting with both feet off the floor; jumping the cue ball by chipping under it (except an unintentional missed cue is not a foul); masseying the cue ball with the cue stick above the shoulder; double-hitting the cue ball; moving the cue ball by touching it with the cue stick, the body or a foreign object other than the intentional striking of the cue ball with the cue stick to move it at an object ball; and moving object balls which subsequently affects the balls in play (accidental movement of object balls that in no way affects the result of the shot is not a foul if before the shot the ball is returned to its proper position). Because in the preferred embodiment the predetermined number of object balls is fifteen (i.e., $n=15$ in the preferred embodiment), a perfect score for one turn, or inning, per player is fifteen points if all fifteen of the object balls are legally pocketed during the turn.

Each player's turn begins by grouping all but one of the object balls on the table. In the preferred embodiment this is done by the player racking all fifteen balls with the head ball on the foot spot 18 and then removing the head ball sitting on the foot spot 18 without disturbing the other object balls. This leaves the remaining fourteen object balls aligned on the table playing surface 4 in the shape of a truncated triangle having the missing apex of the truncated triangle substantially centered on the foot spot 18. The resultant racked set of object balls 20 thus sits at a predetermined location on the table at the beginning of each player's turn or inning. It is contemplated that a different predetermined location could be used (e.g., centering the racked set on the foot spot).

The removed fifteenth object ball is placed by the player at any location selected by the player anywhere on the table other than where the racked set of object balls 20 is located. Likewise, the player selects any other location anywhere on the table other than where the racked set of object balls 20 and the object ball 22 are located and places the cue ball at such other selected location. In the preferred embodiment such location selection and ball placement are to be performed only at the beginning of each turn. Once the first shot of a turn has been taken, the cue ball and the object balls are played where they lie or sit after each shot for the remainder of that turn.

With the racked set of object balls 20 aligned at its predetermined location and with the balls 22, 24 placed at their selected locations, an attempt to pocket any of the object balls is made by the player moving the cue ball at any of the object balls. In the preferred embodiment this movement is made by striking the cue ball, wherever it sits on the table, a single time with a cue. A mis-cue on the initial shot of a player's turn counts as the first shot only if the cue ball 24 causes any of the object balls to move. The player is allowed to repeat this step only so long as both the immediately preceding movement of the cue ball legally caused at least one of the object balls to enter any of the pockets 6, 8, 10, 12, 14, 16 of the table 2 and there is at least one object ball remaining on the table. That is, whenever an object ball is legally pocketed, the player continues shooting until either no object ball is pocketed on a shot or no object ball remains on the table. In the latter event, the player would have achieved a perfect score of fifteen points for having pocketed all fifteen balls. A player's turn also ends if the player commits one of the aforementioned fouls. Any object ball pocketed on a foul stroke does not count. In making a shot, the player is not required to designate which object ball is to be hit or pocketed or in which pocket the player is attempting to pocket a ball. The cue ball may strike any object ball.

At the end of each player's turn, the number of object balls legally pocketed by the player during that turn is counted. One point is awarded for each legally pocketed ball, and the total number of points is recorded on a score sheet. This score is added to the player's predetermined handicap which is a per turn value as subsequently described.

The game is over when each player has completed the specified, predetermined number of turns or innings. This is accomplished by the player repeating the foregoing steps a predetermined number of times. Each set of these steps is performed by all the players so that the cumulative performance of these steps for all the players defines a complete turn or inning of the event. This is repeated the predetermined number of times so that a corresponding predetermined number of innings is played by each of the players. The player whose total score, comprising the sum of the actual number of balls pocketed each turn by that player plus the per turn handicap for that player, is highest wins the particular event of the game.

The predetermined handicap number which is assigned to each player represents a corresponding number of object balls for which the player will be credited each turn regardless of the actual number of object balls pocketed by the player during that turn. The first assignment is made by crediting the respective player with a preselected number of object balls as the player's first respective predetermined number before the player has performed the other steps of the game for the first time. Subsequent assignments are made by computing each subsequent one of the predetermined number or handicap for each subsequent event played by the respective player. This computation includes determining a new average for each respective player and subtracting the new average from the maximum number of object balls which can be pocketed during a turn, which number is n. In the preferred embodiment this maximum number is fifteen. The resultant difference between n and the new average defines the new handicap to be used by the player the next time he or she plays the game.

Determining a new average for a player at an entry level includes computing the average number of object balls actually pocketed each turn once the respective player has played the game the first time. If this average number is less than the preselected number credited to the player before he or she played the game this first time, the new average determination also includes adding the preselected number and the average number to define a sum and dividing the sum by two to define a new entry level average. When the player plays his or her next game, the next average number of object balls actually pocketed each turn during that subsequent game is computed so that the new entry level average existing at the beginning of that next game becomes a previous entry level average. This next average number is compared to the previous entry level average to determine if the next average is greater than the previous entry level average. If the next average number is not greater than the previous entry level average, the next average number is added to the previous entry level average, the resultant sum is divided by two, and then further averages and comparisons are made as subsequent games are played. If, on the other hand, the next average number is greater than the previous entry level average, the next average number is equated to a new established level average and thereafter the following steps are performed: computing the next average number of object balls actually pocketed each turn after the respective player has subsequently played the game so that the then-existing new established level average becomes a previous established level average; comparing this next average number to the previous established level average to determine if the next average number is greater than the previous established level average; if the next average number is greater than the previous established level average, multiplying the previous established level average by three, adding the next average number to the resultant product, and dividing that sum by four; and if the next average number is not greater than the previous established level average, multiplying the previous established level average by nine, adding the next average number to the resultant product, and dividing the resultant sum by ten.

By way of a specific example, in the preferred embodiment a player who has never played the game (at least for handicapping purposes) is assigned an initial handicap of seven points (balls) per inning. Each time a player completes an appropriate event of playing the game, his or her average is updated by the aforementioned method which is algebraically represented by the following three formulas:

ENTRY LEVEL FORMULA new average=(previous average+event average)/2
new handicap=15− new average Changeover Formula new average=event average new handicap=15− new average Established Level Formula A score above previous average establishes a new average and a new handicap as follows:

new average=(3× previous average+event average)/4 new handicap=15− new average

A score below previous average establishes a new average and a new handicap as follows:

new average=(9× previous average+event average)/4 new handicap=15− new average

These three formulas are designated "entry level", "changeover" and "established level". A player's average and handicap are calculatd by the "entry level" formula until he or she completes one event with a score above his or her previous average. The first time a player completes an event with a score above his or her previous average, the "changeover" formula is used. The "changeover" formula is used only once; it is used on the first event if the player pockets an average of more than eight balls per inning. After the "changeover" formula has been used once, the "established" formula is used.

This game which I have invented is the only pocket billiards game of which I am aware where one object ball is optionally placed for the break shot, wherein "break shot" here refers to the first stroke after racking the balls (i.e., the first shot of each turn). This game is also the only pocket billiards game of which I am aware where the cue ball is optionally placed anywhere on the table for the break shot. Other pocket billiards games of which I am aware require the cue ball to be placed within a section of the table for the break shot. For example, pool games require the cue ball to be behind the "head string" and snooker requires the cue ball to be placed inside the "D". My game is also the only pocket billiards game of which I am aware that requires *both* of the following: a player's turn ends the first time a stroke (shot) does not result in a pocketed object ball, and the number of turns is predetermined and equal for all contestants.

Thus, the present invention is well adapted to carry out the objects and attain the ends and advantages mentioned above as well as those inherent therein. While a preferred embodiment of the invention has been described for the purpose of this disclosure, changes in the construction and arrangement of parts and the performance of steps can be made by those skilled in the art, which changes are encompassed within the spirit of this invention as defined by the appended claims.

What is claimed is:

1. A method of playing a method of playing a game on a pocket billiards table with fifteen object balls and a cue ball, which table has a foot spot, said method comprising the steps of:

(a) aligning fourteen of the object balls into the shape of a truncated triangle having the missing apex of the truncated triangle substantially centered on the foot spot;

(b) placing the remaining object ball anywhere on the table;

(c) placing the cue ball anywhere on the table;

(d) moving the cue ball for the purpose of striking any of the object balls;

(e) repeating said step (d) so long as both the immediately preceding movement of the cue ball caused at least one of the object balls to enter any of the pockets of the table and there is at least one object ball remaining on the table; and (f) repeating steps (a) through (e) a predetermined number of times.

2. A method as defined in claim 1, wherein:

said method further comprises the step of (g) performing said steps (a) through (e) together for each of several players so that the cumulative performance of said steps (a) through (e) for all the players defines an inning; and said step (f) includes repeating said step (g) the predetermined number of times so that a corresponding predetermined number of innings is played by each of the several players.

3. A method as defined in claim 2, further comprising the step of (h) counting the number of object balls pocketed by each player during each inning.

4. A method of playing a game wherein the goal is to move object balls along a table into pockets and wherein players of different abilities can compete in a common event, comprising the steps of:

(a) assigning to each player a respective predetermined number representing a corresponding number of object balls for which the player will be credited each turn regardless of the actual number of object balls pocketed by the player during the turn;

(b) grouping all but one of the object balls on the table;

(c) placing the remaining object ball anywhere on the table;

(d) placing a cue ball anywhere on the table;

(e) attempting to pocket any of the object balls by striking the cue ball, wherever it sits on the table, a single time with a cue to move the cue ball at any of the object balls;

(f) if any object ball is legally pocketed during said step (e), repeating step (e) until no object ball is legally pocketed or remains on the table;

(g) counting the number of object balls pocketed during said steps (e) and (f);

(h) adding the number counted during said step (g) to the predetermined number assigned during said step (a); and (i) repeating said steps (b) through (h) for each player a predetermined number of times.

* * * * *

UNITED STATES PATENT AND TRADEMARK OFFICE

CERTIFICATE OF CORRECTION

PATENT NO. : 4,784,388

DATED : November 15, 1988

INVENTOR(S) : Donald W. Owen

It is certified that error appears in the above-identified patent and that said Letters Patent are hereby corrected as shown below:

Column 1, line 14, change "gainst" to --against--; and

Column 6, line 8 (claim 1), delete the second occurrence of "a method of playing".

Signed and Sealed this

Twenty-first Day of March, 1989

*Attest:*

DONALD J. QUIGG

*Attesting Officer*

*Commissioner of Patents and Trademarks*